United States Patent [19]

Hergert

[11] Patent Number: 5,034,098

[45] Date of Patent: Jul. 23, 1991

[54] METHOD OF FORMING A PAPER WEB

[75] Inventor: Richard E. Hergert, Rockton, Ill.

[73] Assignee: Beloit Corporation, Beloit, Wis.

[21] Appl. No.: 483,858

[22] Filed: Feb. 23, 1990

[51] Int. Cl.[5] ..... D21F 9/02; D21F 1/00

[52] U.S. Cl. ..... 162/203; 162/300; 162/301

[58] Field of Seareh ..... 162/203, 300, 301, 303, 162/352

[56] References Cited

U.S. PATENT DOCUMENTS

| | | | |
|---|---|---|---|
| 4,146,424 | 3/1979 | Justus | 162/203 |
| 4,414,061 | 11/1983 | Trufitt et al. | 162/301 |
| 4,417,950 | 11/1983 | Bubik et al. | 162/300 |
| 4,554,052 | 11/1985 | Waris | 162/301 |
| 4,830,709 | 5/1989 | Turner et al. | 162/203 |

FOREIGN PATENT DOCUMENTS

| | | | |
|---|---|---|---|
| 817630 | 7/1969 | Canada | 162/301 |
| 0136000 | 3/1985 | United Kingdom | 162/301 |

*Primary Examiner*—Karen M. Hastings

*Attorney, Agent, or Firm*—Dirk J. Veneman; Raymond W. Campbell; David J. Archer

[57] ABSTRACT

A method is disclosed for forming a paper web having a low tensile ratio. The method includes the steps of ejecting stock substantially horizontally from a headbox, and receiving the rejected stock onto a substantially horizontally disposed looped first wire, moving at substantially the same speed and the same direction as the ejected stock. The arrangement is such that a first portion of water is removed from the ejected stock downwardly through the first wire during passage of the ejected stock through an initial dewatering zone. The partially dewatered stock is sandwiched between the first wire and a looped second wire, the wires defining therebetween a secondary dewatering zone for further dewatering the ejected stock. A second and third portion of water are removed downwardly and upwardly, respectively, through the first and second wires during movement of the ejected stock past a curved shoe. The curvature of the secondary dewatering zone is reversed such that the wires extend around a curved inverted box connected to a source of partial vacuum, so that a fourth portion of water is removed upwardly through the second wire into the curved box. The arrangement is such that a gradual dewatering of the ejected stock is accomplished during passage of the stock through the initial and secondary dewatering zones, thereby inhibiting removal of fines from the ejected stock and minimizing the tensile ratio of the resultant web.

10 Claims, 3 Drawing Sheets

54'
56'
58'
52'
26
24
22
20
18
16
14
12
10
8
6
NUI FORMATION
0.92
0.94
0.96
0.98
1.00
1.02
1.04
1.06
1.08
1.10
JET / WIRE RATIO

METHOD OF FORMING A PAPER WEB

BACKGROUND OF THE INVENTION

1. FIELD OF THE INVENTION

The present invention relates to a method of forming a paper web having a low tensile ratio. More particularly, the present invention relates to a method of forming a paper web in which a gradual dewatering of the ejected stock is accomplished, thereby inhibiting removal of fines from the ejected stock and minimizing the tensile ratio of the resultant web.

2. INFORMATION DISCLOSURE STATEMENT

During the manufacture of a web of paper, many factors interact in order to impart particular characteristics to the resultant web.

For example, when stock is ejected from a headbox onto a moving fourdrinier wire, the ratio of the velocity of the ejected stock to the velocity of the moving fourdrinier wire has an affect on the resultant web.

For certain paper grades, particularly for fine paper, the tensile strength of a web in a machine direction should be as close as possible to the tensile strength of the web in the cross-machine direction.

In the papermaking art, such ratio of the aforementioned tensile strength in the machine direction to the cross-machine direction is known as the "tensile ratio".

Particularly during the manufacture of envelopes and the like, it is desirable that the tensile ratio be as near as possible to unity, so that during the paper converting operation the sheet of paper responds equally regardless of the direction in which the sheet is folded.

The Horizontal Bel Baie forming machine taught in U.S. patent application 07/127,525, now U.S. Pat. No. 4,894,120, assigned to Beloit Corporation characteristically has a high drainage capacity and includes the advantage of fines retention within the ejected stock. Nevertheless, the Horizontal Bel Baie typically does not form a web having a tensile ratio less than two, regardless of the aforementioned jet-to-wire ratio. Horizontal Bel Baie is a trademark of Beloit Corporation.

The present invention overcomes the aforementioned problem of manufacturing a web having a relatively low tensile ratio by incorporating the features of the Horizontal Bel Baie and a curved inverted vacuum box of a twin wire Bel Bond machine, together with an initial single wire dewatering zone.

Therefore, it is a primary object of the present invention to provide a method of forming a paper web having a low tensile ratio, the method providing a significant and nonobvious contribution to the art of papermaking.

Another object of the present invention is the provision of a method of making a paper web having a low tensile ratio while maintaining fines retention.

Other objects and advantages of the present invention will be apparent to those skilled in the art by a consideration of the detailed description contained hereinafter taken in conjunction with the annexed drawings.

SUMMARY OF THE INVENTION

The present invention relates to a method of forming a paper web having a low tensile ratio. The method comprises the steps of ejecting stock substantially horizontally from a headbox. The stock is received onto a horizontally disposed looped first wire moving at approximately the same speed and the same direction as the ejected stock. The arrangement is such that a first portion of water is removed from the ejected stock downwardly through the first wire during passage of the ejected stock through an initial dewatering zone. The partially dewatered stock is then sandwiched between the first wire and a looped second wire moving in the same direction and at the same speed as the first wire. The wires define therebetween a secondary dewatering zone for further dewatering the ejected stock. The secondary dewatering zone is disposed downstream relative to the initial dewatering zone. The wires are guided over a discontinuous curved dewatering shoe such that a second portion of water is removed downwardly through the first wire during movement of the ejected stock past the shoe. A third portion of water is removed centrifugally upwardly through the second wire during movement of the wires around the curved shoe. Although the term "removed centrifugally" is used hereinafter, it will be appreciated by those skilled in the art that such removal of water is mainly accomplished by the respective wires cooperating together to press such water from the stock by a squeezing action. Therefor, in the present application, such squeezing action is included in the references to centrifugal removal of water. The third portion of water is collected through a vacuum slot disposed on the opposite side of the wires relative to the curved dewatering shoe. The curvature of the secondary dewatering zone is then reversed such that the wires extend around a curved inverted box connected to a source of partial vacuum so that a fourth portion of water is removed upwardly through the second wire into the curved box. The arrangement is such that a gradual dewatering of the ejected stock is accomplished during passage of the stock through the initial and secondary dewatering zones, thereby inhibiting removal of fines from the ejected stock and minimizing the tensile ratio of the resultant web.

In a more specific method of carrying out the present invention, the step of ejecting the stock is carried out at a distance within the range 0.25 to 10 meters from the secondary dewatering zone.

The step of receiving the ejected stock includes removing the first portion of water from the ejected stock by gravity.

Furthermore, the step of receiving the ejected stock includes adjusting the distance between the headbox and the second wire such that the tensile ratio of the resultant web is minimal relative to the particular characteristics of the ejected stock.

The step of sandwiching the partially dewatered stock begins immediately downstream relative to the initial dewatering zone.

The step of guiding the wires also includes applying a partial vacuum through the dewatering shoe for assisting the removal of the second portion of water through the first wire.

The step of removing the third portion of water further includes progressively reducing the curvature of the curved shoe in the direction of movement of the wires such that the removal of the third portion of water upwardly through the second wire decreases as the ejected stock moves past the curved shoe.

The step of collecting the third portion of water is accomplished towards a downstream end of the curved shoe. The vacuum slot extends in a cross-machine direction above the second wire such that the third portion of water removed by centrifugal force through the second wire is drawn upwardly through the vacuum slot, thereby inhibiting rewetting of the progressively dewatered stock.

The step of collecting the third portion of water also includes adjusting the spacing between the vacuum slot and the second wire so that the removal of the third portion of water is maximized.

The step of reversing the curvature of the secondary dewatering zone is carried out immediately downstream relative to the step of collecting the third portion of water.

Also, the step of reversing the curvature of the secondary dewatering zone includes centrifugally removing a fifth portion of water downwardly through the first wire during movement of the progressively dewatered stock around the curved inverted vacuum box.

In one embodiment of the present invention, the wires move around a roll which is disposed downstream relative to the inverted box such that a sixth portion of water is centrifugally removed downwardly through the first wire as the web formed from the dewatered stock passes around the roll. The roll is disposed on the same side of the wires as the inverted box and has a radius which is less than the radius of curvature of the inverted box.

Also, the wires are passed over an evacuated radius top box which is disposed downstream relative to the inverted box for removing a seventh portion of water downwardly through the first wire. The radius top box is disposed downstream and on the opposite side of the wires relative to the roll.

Many modifications and variations of the present invention will be readily apparent to those skilled in the art by a consideration of the detailed description contained hereinafter taken in conjunction with the annexed drawings which show a preferred embodiment for carrying out the process steps of the present invention.

Included in such modifications would be increasing the curvature of the curved shoe in the direction of movement of the wires.

Alternatively, the curvature may remain constant along the length of the curved shoe.

However, such modifications and variations fall within the spirit and scope of the present invention as defined by the appended claims.

BRIEF DESCRIPTION OF THE DRAWINGS

Similar reference characters refer to similar features throughout the various figures of the drawings.

DETAILED DESCRIPTION OF THE DRAWINGS

Figure 1:
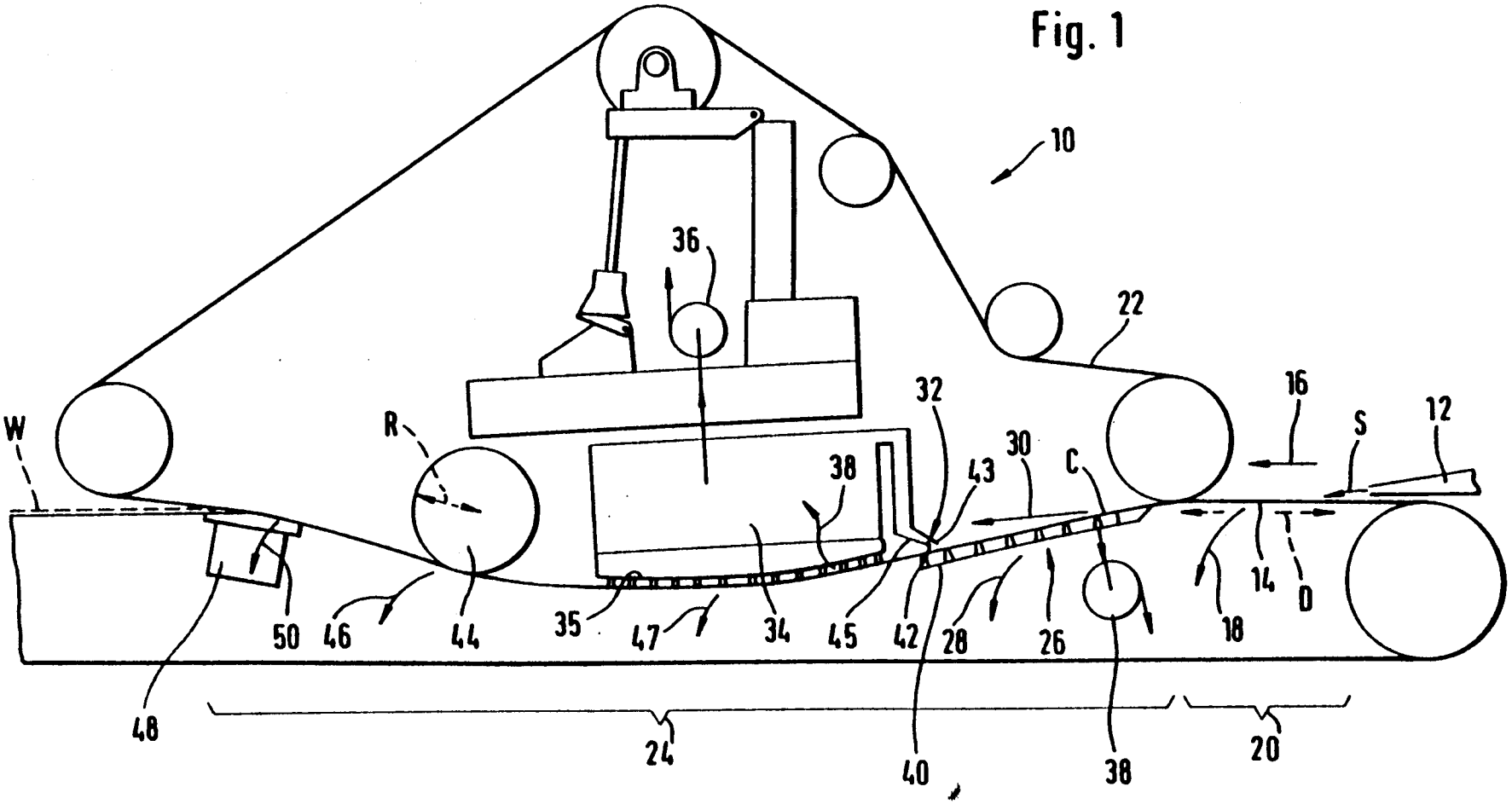
FIG. 1 is a side-elevational view of a forming apparatus for forming a web according to the various method steps of the present invention.

FIG. 1 is a side-elevational view of a forming apparatus generally designated 10 for forming a paper web W having a low tensile ratio according to the method steps of the present invention.

Stock generally designated S is ejected substantially horizontal from a headbox 12. The ejected stock S is received on a substantially horizontal disposed looped first wire 14 which moves at substantially the same speed and direction, as indicated by the arrow 16, as the ejected stock S. The arrangement is such that a first portion of water, indicated by the arrow 18, is removed from the ejected stock S downwardly through the first wire 14 during passage of the ejected stock S through an initial dewatering zone 20. The partially dewatered stock S is then sandwiched between the first wire 14 and a looped second wire 22 which moves in the same direction 16 and at the same speed as the first wire 14. The first and second wires 14 and 22 define therebetween a secondary dewatering zone 24 for further dewatering the ejected stock S. The secondary dewatering zone 24 is disposed downstream relative to the initial dewatering zone 20.

The wires 14 and 22 are guided over a discontinuous curved dewatering shoe generally designated 26 such that a second portion of water, as indicated by the arrow 28, is removed downwardly through the first wire 14 during movement of the ejected stock S past the shoe 26.

A third portion of water, indicated by the arrow 30, is centrifugally removed upwardly through the second wire 22 during movement of the wires 14 and 22 around the curved shoe 26.

The third portion of water 30 is collected within a vacuum slot 32 disposed on the opposite side of the wires 14 and 22 relative to the dewatering shoe 26.

The curvature of the secondary dewatering zone 24 is then reversed such that the wires 14 and 22 extend around a curved inverted box 34 connected to a source of partial vacuum 36 so that a fourth portion of water, indicated by the arrow 38, is removed upwardly through the second wire 22 into the curved box 34. The arrangement is such that a gradual dewatering of the ejected stock is accomplished during passage of the stock through the initial and secondary dewatering zone 20 and 24 respectively, thereby inhibiting removal of fines from the ejected stock and minimizing the tensile ratio of the resultant web W.

The step of ejecting the stock S from the headbox 12 is carried out at a distance D within the range 0.25 to 10 meters from the secondary dewatering zone 24.

The step of receiving the ejected stock includes removing the first portion of water 18 from the ejected stock by gravity.

The step of receiving the ejected stock includes adjusting the distance D between the headbox 12 and the second wire 22 such that the tensile ratio of the resultant web W is minimal relative to the particular characteristics of the ejected stock S.

The step of sandwiching the partially dewatered stock begins immediately downstream relative to the initial dewatering zone 20.

The step of guiding the wires 14 and 22 respectively further includes applying a partial vacuum, as indicated by 38, through the dewatering shoe 26 for assisting removal of the second portion of water 28 through the first wire 14.

The step of removing the third portion of water 30 further includes progressively reducing the curvature C of the curved shoe 26 in the direction of movement 16 of the wires 14 and 22 such that the removal of the third portion of water 30 upwardly through the second wire 22 decreases as the ejected stock moves past the curved shoe 26.

The step of collecting the third portion of water 30 is accomplished towards a downstream end 40 of the curved shoe 26. The vacuum slot 32 extends in a cross-machine direction above the second wire 22 such that the third portion of water 30 removed by centrifugal force through the second wire 22 is drawn upwardly through the vacuum slot 32, thereby inhibiting rewetting of the progressively dewatered stock.

The step of collecting the third portion of water also includes adjusting the spacing 42 between an upper lip 43 of the vacuum slot 32 and a stationary lower lip 45 of the vacuum slot 32 disposed adjacent the second wire 22 so that the removal of the third portion of water 30 is maximized.

The step of reversing the curvature of the secondary dewatering zone 24 is carried out immediately downstream relative to the step of collecting the third portion of water 30.

The step of reversing the curvature of the secondary dewatering zone 24 also includes centrifugally removing a fifth portion of water downwardly, as indicated by the arrow 47, through the first wire 14 during movement of the progressively dewatered stock S around the curved inverted box 34.

In one embodiment of the present invention, the wires 14 and 22 move around a roll 44 which is disposed downstream relative to the inverted box 34. The arrangement is such that a sixth portion of water, as indicated by the arrow 46, is centrifugally removed downwardly through the first wire 14 as the web W formed from the dewatered stock passes around the roll 44. The roll 44 is on the same side of the wires 14 and 22 as the inverted box 34 and has a radius R which is less than the radius of curvature 35 of the inverted box 34.

In the aforementioned embodiment of the present invention, the wires 14 and 22 pass over an evacuated radius top box 48 which is disposed downstream relative to the inverted box 34 for removing a seventh portion of water, indicated by the arrow 50, downwardly through the first wire 14. The radius top box 48 is disposed downstream and on the opposite side of the wires 14 and 22 relative to the roll 44. The radius top box also permits a transfer of the web to the lower first wire 14.

In operation of the apparatus 10, according to the present invention, the stock S is ejected onto the bottom wire 14, and water is drained from the stock progressively as the stock is supported first by the wire 14 and thereafter between the wires 14 and 22. The first portion of water 18 is removed downwardly by gravity, and then a second portion of water 28 is removed downwardly through the shoe 26, such removal being assisted by the vacuum means 38. The shoe 28 has a decreasing radius of curvature C towards the downstream end 40 such that the third portion of water 30 removed centrifugally through the second wire 22 decreases towards the vacuum slot 32.

Thereafter, the curvature of the secondary dewatering zone 24 changes as the wires extend around the curved inverted vacuum box 34 such that a fourth portion of water 38 and a fifth portion of water 42 are removed respectively upwardly and downwardly relative to the wires.

The wires then extend around the roll 44 such that a sixth portion of water 46 is removed downwardly as a result of the wires curving around the roll 44.

Finally, the wires extend around the evacuated radius top box 48 such that the seventh portion of water is removed downwardly through the radius top box.

The apparatus, according to the present invention, enables a gradual dewatering of the stock S, and test results have clearly indicated that the tensile ratio of the resultant web W is decreased by the method steps according to the present invention.

Figure 2:
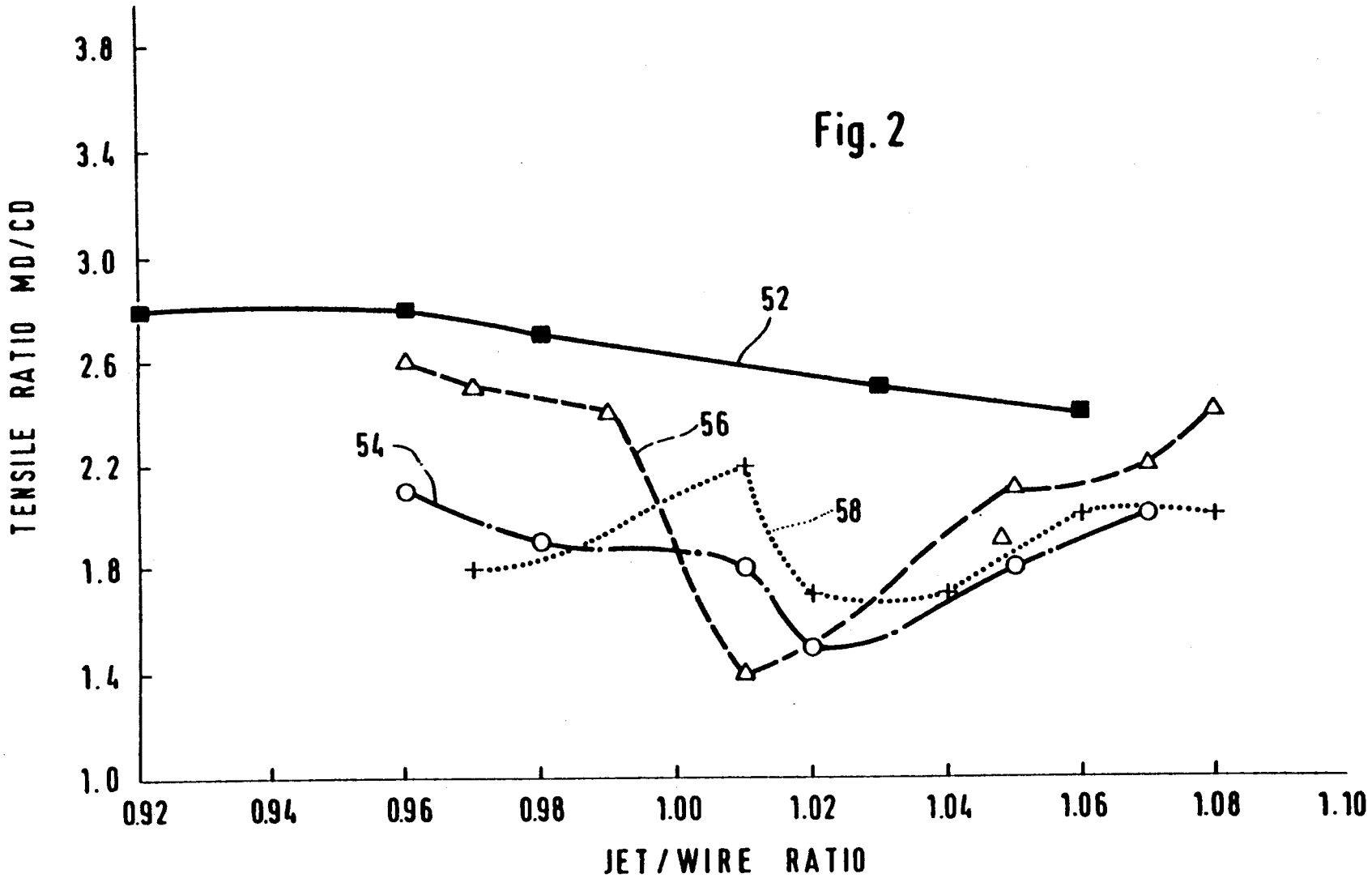
FIG. 2 is a graph comparing the tensile ratio of webs formed by the process according to the present invention.

FIG. 2 is a graph showing the tensile ratio of the resultant web when the ratio of the ejected stock jet velocity to wire velocity is varied. FIG. 2 shows various graphs indicating test results obtained from a Horizontal Bel Baie true gap former compared with graphs indicating test results according to the present invention. The graph being indicated by the numeral 52 shows the results for a Horizontal Bel Baie. As can be seen from FIG. 2, when the jet to wire ratio is 1, the tensile ratio of the web formed by the Horizontal Bel Baie former is in the region of 2.6.

Graphs 54, 56 and 58, respectively, show the results obtained according to the present invention when the distance D of the initial dewatering, or preforming, zone is 6 meters, 2 meters and 1 meter respectively.

As can be seen from the graph shown in FIG. 2, for a jet to wire ratio of just over 1, the tensile ratio in each of the graphs 54, 56 and 58 was within the range 1.4 to 1.7.

The test results indicated in FIG. 2 each involved stock having a consistency by weight of 80% hardwood kraft and 20% softwood kraft. The resultant web in each instant had a basis weight of 80 grams per square meter.

Figure 3:
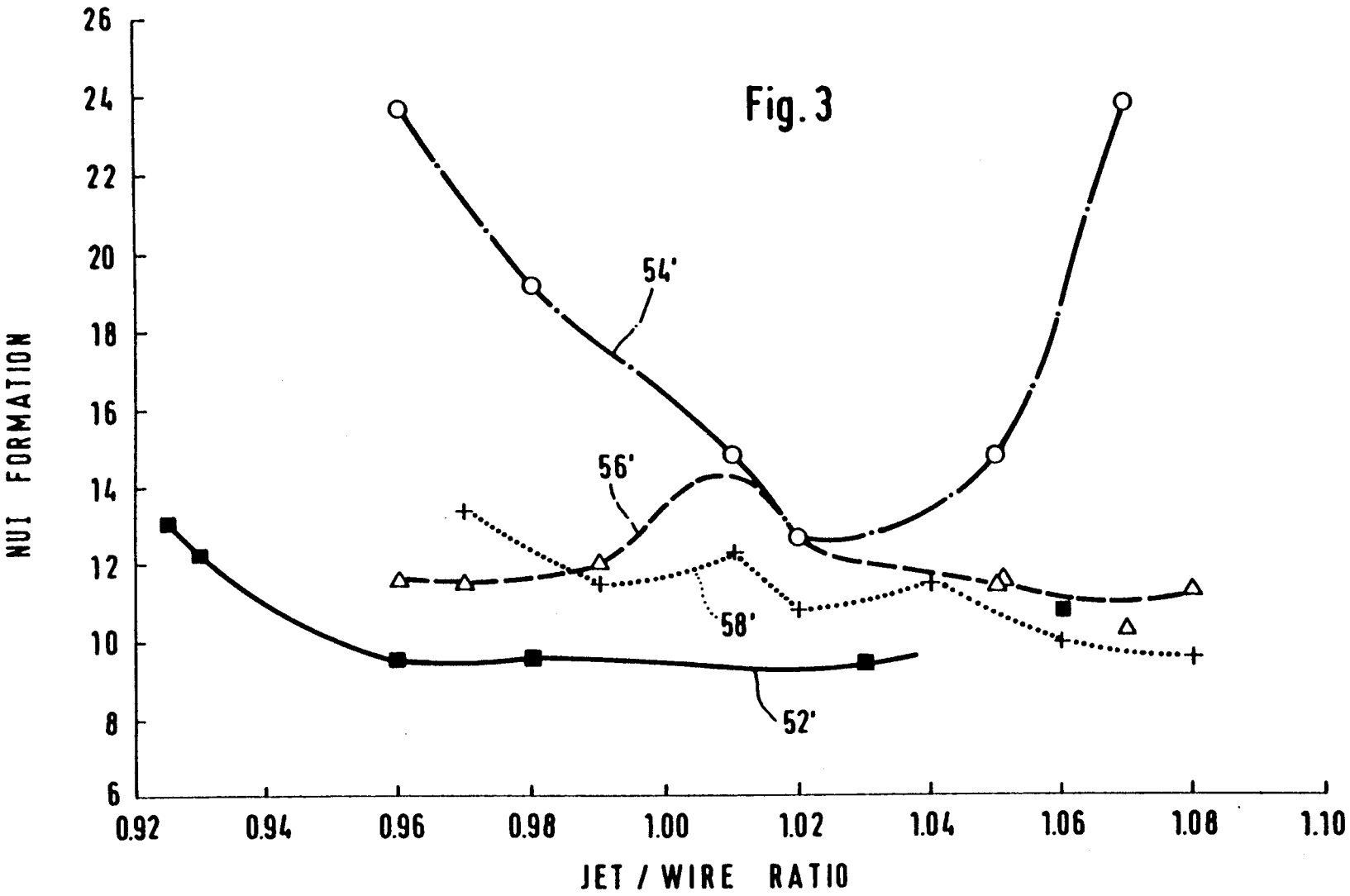
FIG. 3 is a graph comparing the formation of webs formed by the process according to the present invention.

FIG. 3 shows various graphs comparing the formation characteristics of a web formed on a Horizontal Bel Baie to webs formed according to the process of the present invention.

More specifically, as shown in FIG. 3, each graph shows the respective non-uniformity index (NUI) to the jet-to-wire ratio. The non-uniformity index is a reading obtained by a laboratory meter developed at Reed Limited in Quebec, Canada, and measures the variation in light transmittance through a sheet to provide an indication of sheet formation. The graph 52' shows the test results for a web formed on a Horizontal Bel Baie. Graphs 54', 56' and 58' show, respectively, the results obtained from webs formed according to the process of the present invention where the distance D was 6 meters, 2 meters and 1 meter, respectively.

As can be seen from FIG. 3, for a jet-to-wire ratio of slightly more than 1, there is little difference in the formation of the web according to the process of the present invention compared with the results obtained from a Horizontal Bel Baie former.

As in the test results shown in FIG. 2, the test results indicated in FIG. 3 were for an 80 grams per square meter sheet produced from an 80% HWK/20% SWK stock.

The present invention therefore provides a method of forming a web which greatly reduces the tensile ratio of the resultant web and also has the advantage of fines retention while avoiding two-sidedness of the resultant web.

What is claimed is:

1. A method of forming a paper web having a low tensile ratio, said method comprising the steps of:

ejecting stock substantially horizontal from a headbox;

receiving the ejected stock onto a substantially horizontally disposed looped first wire moving at substantially the same speed and same direction as the ejected stock such that a first portion of water is removed from the ejected stock downwardly through the first wire during passage of the ejected stock through an initial dewatering zone;

sandwiching the partially dewatered stock between the first wire and a looped second wire moving in the same direction and at the same speed as the first wire, the first and second wires defining therebetween a secondary dewatering zone for further dewatering the ejected stock, the secondary dewatering zone being disposed downstream relative to the initial dewatering zone;

guiding the wires over a discontinuous curved dewatering shoe such that a second portion of water is removed downwardly through the first wire during movement of the ejected stock past the shoe;

centrifugally removing a third portion of water upwardly through the second wire during movement of the wires around the curved shoe;

collecting the third portion of water within a vacuum slot disposed on the opposite side of the wires relative to the dewatering shoe; reversing the curvature of the secondary dewatering zone immediately downstream relative to the step of collecting the third portion of water such that the wires extend around a curved inverted box connected to a source of partial vacuum so that a fourth portion of water is removed upwardly through the second wire into the curved box, and a fifth portion of water is removed centrifugally downwardly through the first wire during movement of the progressively dewatered stock around the curved inverted box; moving the wires around a roll disposed downstream relative to the inverted box such that a sixth portion of water is centrifugally removed downwardly through the first wire as the web formed from the dewatered stock passes around the roll, the roll being on the same side of the wires as the inverted box and having a radius of curvature which is less than the radius of curvature of the inverted box; the method being such that a gradual dewatering of the ejected stock is accomplished during passage of the stock through the initial and secondary dewatering zones, thereby inhibiting removal of fines from the ejected stock and minimizing the tensile ratio of the resultant web; and the step of receiving the ejected stock including:

adjusting the distance between the headbox and the second wire such that the tensile ratio of the resultant web is minimal.

2. A method as set forth in claim 1 wherein the step of ejecting stock is carried out at a distance within the range 0.25 to 10 meters from the secondary dewatering zone.

3. A method as set forth in claim 1 wherein the step of receiving the ejected stock includes:

removing the first portion of water from the ejected stock by gravity.

4. A method as set forth in claim 1 wherein the step of sandwiching the partially dewatered stock begins immediately downstream relative to the initial dewatering zone.

5. A method as set forth in claim 1 wherein the step of guiding the wires further includes:

applying a partial vacuum through the dewatering shoe for assisting the removal of the second portion of water through the first wire.

6. A method as set forth in claim 1 wherein the step of removing the third portion of water further includes:

progressively reducing the curvature of the curved shoe in the direction of movement of the wires such that the removal of the third portion of water upwardly through the second wire decreases as the ejected stock moves past the curved shoe.

7. A method as set forth in claim 1 wherein the step of collecting the third portion of water is accomplished towards a downstream end of the curved shoe, the vacuum slot extending in a cross-machine direction above the second wire such that the third portion of water removed by centrifugal force through the second wire is drawn upwardly through the vacuum slot, thereby inhibiting rewetting of the progressively dewatered stock.

8. A method as set forth in claim 7 wherein the step of collecting the third portion of water further includes:

adjusting the spacing between the vacuum slot and the second wire so that the removal of the third portion of water is maximized.

9. A method as set forth in claim 1 further including the step of:

passing the wires over an evacuated radius top box disposed downstream relative to the inverted box for removing a strength portion of water downwardly through the first wire, the radius top box being disposed downstream and on the opposite side of the wires relative to the roll.

10. An apparatus for forming a paper web having a low tensile ratio, said apparatus comprising:

a headbox for ejecting stock substantially horizontally;

a substantially horizontally disposed looped first wire cooperating with said ejected stock, said first wire moving at substantially the same speed and direction as the ejected stock such that a first portion of water is removed from the ejected stock downwardly through said first wire during passage of the ejected stock through an initial dewatering zone;

a looped second wire moving in the same direction and at the same speed as said first wire such that the partially dewatered stock is sandwiched between said first and second wires, said wires defining therebetween a secondary dewatering zone for further dewatering the ejected stock, said secondary dewatering zone being disposed downstream relative to said initial dewatering zone;

a discontinuous curved dewatering shoe for guiding said wires such that a second portion of water is removed downwardly through said first wire during movement of the ejected stock past said shoe, a third portion of water being centrifugally removed upwardly through said second wire during movement of said wires around said curved shoe;

a vacuum slot disposed on the opposite side of said wires relative to said dewatering shoe for collecting said third portion of water;

a curved inverted box connected to a source of partial vacuum disposed immediately downstream relative to said vacuum slot for reversing the curvature of said secondary dewatering zone such that said wires extend around said inverted box so that a fourth portion of water is removed upwardly through said second wire into the curved box and a fifth portion of water is removed centrifugally downwardly through the first wire during movement of the progressively dewatered stock around the curved inverted box; a roll disposed downstream relative to the inverted box such that a sixth portion of water is centrifugally removed downwardly through the first wire as the web formed from the dewatered stock passes around the roll, the roll being on the same side of the wires as the inverted box and having a radius of curvature which is less than the radius of curvature of the inverted box; the apparatus being arranged such that a gradual dewatering of the ejected stock is accomplished during passage of the stock through said initial and secondary dewatering zones, thereby inhibiting removal of fines from the ejected stock and minimizing the tensile ratio of the resultant web; and said headbox being disposed at a distance relative to said second wire such that the tensile ratio of the resultant web is minimal.

* * * * *

UNITED STATES PATENT AND TRADEMARK OFFICE

CERTIFICATE OF CORRECTION

PATENT NO. : 5,034,098

DATED : July 23, 1991

INVENTOR(S) : Richard E. Hergert

It is certified that error appears in the above—identified patent and that said Letters Patent is hereby corrected as shown below:

Column 8, Line 26: Please delete "strength" and insert therefor --seventh--.

Signed and Sealed this

First Day of December, 1992

*Attest:*

DOUGLAS B. COMER

*Attesting Officer*

*Acting Commissioner of Patents and Trademarks*